US011713598B2

(12) United States Patent
Yuan

(10) Patent No.: US 11,713,598 B2
(45) Date of Patent: Aug. 1, 2023

(54) HANDCUFF WITH AUTOMATIC OVER-TIGHTENING-PREVENTION MECHANISM

(71) Applicant: Defang Yuan, Ottawa (CA)

(72) Inventor: Defang Yuan, Ottawa (CA)

( * ) Notice: Subject to any disclaimer, the term of this patent is extended or adjusted under 35 U.S.C. 154(b) by 103 days.

(21) Appl. No.: 17/378,372

(22) Filed: Jul. 16, 2021

(65) Prior Publication Data

US 2023/0016292 A1 Jan. 19, 2023

(51) Int. Cl.
*E05B 75/00* (2006.01)
*E05B 15/00* (2006.01)

(52) U.S. Cl.
CPC ..... *E05B 75/00* (2013.01); *E05B 15/0046* (2013.01)

(58) Field of Classification Search
CPC ..... E05B 75/00; E05B 15/0046
See application file for complete search history.

(56) References Cited

U.S. PATENT DOCUMENTS

| | | | | |
|---|---|---|---|---|
| 5,138,852 | A * | 8/1992 | Corcoran | E05B 75/00 70/16 |
| 6,672,116 | B1 * | 1/2004 | Hilliard | E05B 75/00 70/16 |
| 8,904,832 | B1 * | 12/2014 | Rodriguez | E05B 75/00 70/16 |
| 9,551,170 | B1 * | 1/2017 | Kovac | E05B 27/0003 |
| 10,501,965 | B1 * | 12/2019 | Chaput | E05B 75/00 |
| 2005/0257581 | A1 * | 11/2005 | Voorhees | E05B 75/00 70/16 |
| 2015/0176313 | A1 * | 6/2015 | Hines | E05B 75/00 70/16 |
| 2016/0215528 | A1 * | 7/2016 | Pedric | E05B 75/00 |
| 2020/0131807 | A1 * | 4/2020 | Heiney | E05B 75/00 |
| 2020/0232259 | A1 * | 7/2020 | Parsons | E05B 75/00 |

* cited by examiner

*Primary Examiner* — Mark A Williams

(57) ABSTRACT

The proposed handcuff in the invention employs an innovative locking mechanism, which stops further tightening of the handcuff when the force applied on the wrist of hand or ankle of foot is greater than 1.5 lbs (or any preset value), and prevents physical injuries from over-tightening without compromising the restrain. The handcuff is 50% faster in restraining by automatically locking instead of manually push-to-locking. The handcuff has the same shape/size/cost of the handcuffs currently used by police officer, and is compatible with current training procedure or SOP.

18 Claims, 5 Drawing Sheets

HANDCUFF WITH AUTOMATIC OVER-TIGHTENING-PREVENTION MECHANISM

BACKGROUND OF THE INVENTION

The invention is to design a handcuff with an automatic locking mechanism that is easy to engage even when an individual is struggling or being non-compliant with police officer's direction. The current handcuffs in recent use by the police utilize an intricate double lock. The double lock is enabled once the handcuffs are placed on an individual to prevent possible injury from self-tightening when in use. The lock is engaged by flipping a very small lever inside the key hole of the handcuff using the opposite end of the handcuff key, is referred to as a double lock tip or actuator. The locking mechanism is activated by manual and is often difficult or not possible to engage when officer apprehension involves a struggle, leading to difficulties in placing an individual in handcuffs. The invention disclosure is to employ an automatic pressure-activated mechanism to locking the handcuff and prevent the handcuff from further tightening.

SUMMARY OF THE INVENTION

An automatic over-tightening prevention mechanism is added on the moving strand of handcuff; the moving strand comprises three parts (instead of a single part in conventional handcuff):

1, two forward ratchets (left and right ratchets) are placed in two sides of the moving strand, 2, and one stop ratchet is placed in between the two forward ratchets, The overall shape of the moving strand keeps the same as that of conventional handcuff; the forward ratchets work in exact the same way of conventional handcuff.

The stop ratchet is kept within the two forward ratchets and in left-most position when no force is applied on; and the stop ratchet rotates and moves outwards of the two forward ratchets when a force greater than 1.5 lbs is applied on its inner side, and then the stop ratchet is stopped by a stop pawl and further tightening of the handcuff is prevented.

When the handcuff is restraining on a wrist or an ankle, a force (>1.5 lbs or any preferred force) will be applied on the stop ratchet at the inner side of the stop ratchet, then stop ratchet is immediately engaged and locked by the stop pawl, and then the moving strand as a whole is securely locked. Further tightening of the handcuff is prevented.

The invention eliminates the manually operated push-to-locking latch in conventional handcuff without compromising any function.

The handcuff has the same shape/size as conventional handcuff; there are no sharp or rough edges or any additional hazardous parts added.

The handcuff is triple-locked after engaged on wrist or ankle, and cannot be tampered with simple tools. The stop pawl or lock stops any further tightening, and the other two forward ratchets prevent the device from picking or shimming.

The handcuffs can be engaged and locked 50% faster than a conventional one by automatically locking instead of manually push-to-locking, the handcuff can be easily removed by police officer with a special key, and again is 50% faster than conventional one to remove.

One of the embodiments of the invention is provided:

A handcuff with automatic over-tightening-prevention mechanism comprises a double strand and a moving strand, the moving strand further comprises:

a left ratchet, which is paired with a left stop pawl, a right ratchet, which is paired with a right stop pawl, a stop ratchet, which is paired with a middle stop pawl, a first rivet, a second rivet, a tension spring, wherein the stop ratchet is positioned in between the left and right ratchets, wherein when the stop ratchet is pressed from inner side, it rotates and moves outwards of the left and right ratchets, wherein when the stop ratchet is pressed towards its outmost position, it is engaged with the middle stop pawl and is stopped by the middle stop pawl; wherein further tightening of the handcuff is prevented when the stop ratchet is engaged with the middle stop pawl, wherein the moving strand rotates around the first rivet, wherein the stop ratchet rotates around the second rivet, wherein the rotation of the stop ratchet is constrained by the tension spring, when force applied on the inner side of the stop ratchet is greater than equivalent tension force of the tension spring, the stop ratchet rotates clockwise, or moves outwards of the left and right ratchets; when force applied on the inner side of the stop ratchet is less than the equivalent tension force of the tension spring, the stop ratchet rotates counter clockwise, or moves inwards of the left and right ratchets.

Another embodiment of the invention is provided:

Wherein the above example, the left ratchet and its paired stop pawl are not necessities, the left ratchet can be different in shape and in teeth in comparison to the right ratchet, for example, the left ratchet can be tooth-free, and the left stop pawl can be eliminated, and the forward engagement or restraining functions of the handcuff can be performed by the right ratchet and its paired right stop pawl, and over-tightening-prevention functions can be performed by the middle stop ratchet; this configuration makes handcuff more flexible in manufacturing without compromising most functions.

And another embodiment of the invention is provided:

Wherein the first example, the left ratchet and its paired stop pawl are not necessities, both the left ratchet and its paired stop pawl can eliminated, and the forward engagement or restraining functions of the handcuff can be performed by the right ratchet and its paired stop pawl, and over-tightening-prevention functions can be performed by the stop ratchet and its stop pawl, this configuration makes handcuff very simple in manufacturing without compromising basic functions.

DETAILED SPECIFICATION OF THE INVENTION

Figure 1:
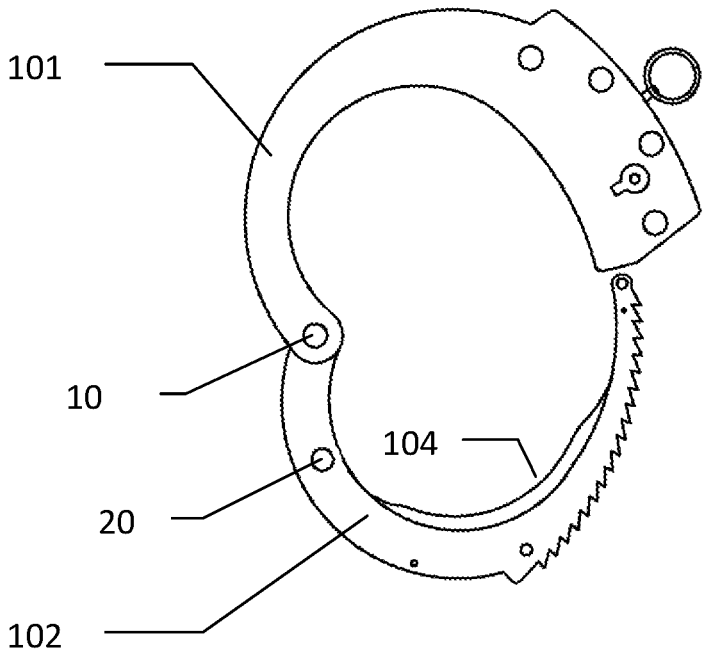
FIG. 1 is an illustration of one of the embodiments of the invention when the handcuff is not engaged.

The present application is a continuation of U.S. Provisional Patent Application No. 63/210,043 filed on 13 Jun. 2021.

And the present application claims the benefit of U.S. Provisional Patent Application No. 63/210,043 filed on 13 Jun. 2021.

Provisional Patent 63/210,043 is incorporated herein by reference in its entirety.

It is to be understood that the disclosure is not limited in its application to the details of the embodiments as set forth in the following description. The invention is capable of other embodiments and of being practiced or of being carried out in various ways.

Furthermore, it is to be understood that the terminology used herein is for the purpose of description and should not be regarded as limiting. Contrary to the use of the term "consisting", the use of the terms "including", "containing", "comprising", or "having" and variations thereof is meant to encompass the items listed thereafter and equivalents thereof as well as additional items. The use of the term "a" or "an" is meant to encompass "one or more". Any numerical range recited herein is intended to include all values from the lower value to the upper value of that range.

Graphics are used in order to simplify the descriptions. Most of the sizes or the parameters in the graphics are scaled for ease of understanding, or are normalized at given conditions. The graphics show a mutual contrast relationship instead of the actual sizes or values.

The directions and positions used in the description, such as up, down, vertically, horizontally, left, right, inwards, outwards, inner, inmost, outmost, clockwise and counter-clockwise are based on the relative directions and relative positions shown in the Figures, and are not necessarily the directions and positions in actual real-life applications.

The engagement of the handcuff means a wrist or a ankle is handcuffed and removal of handcuff is not available without a special key; the engagement of the stop ratchet means a wrist or a ankle is handcuffed and locked, or the lock mechanism is activated, and further tightening of the handcuff is not available unless the force applied on the wrist or ankle is removed or reduced.

In the present invention, two measures are added on the basic functions of a conventional handcuff:

1, Two ratchets (left and right ratchets) are used to engage the moving strand and prevent the moving strand from rotating backwards (or loosening), two ratchets engage with two independent stop pawls to increase the degree of difficulty of unwanted picking or shimming.

2, A stop ratchet paired with a middle stop pawl (or a third pawl) is added to limit the tightening force applied on wrist or ankle. When the stop ratchet is being pressed, it rotates clockwise. When the stop ratchet engages with the third stop pawl, it is engaged and locked and further tightening is prevented. And a tension spring is used to control or preset a equivalent tension force, when force applied on the ratchet is greater than the equivalent force, the stop ratchet is engaged and the handcuff is locked; when force applied on the ratchet is smaller than the equivalent force, the stop ratchet is not engaged or not locked, and then the handcuff is be engaged but not locked, and the handcuff can be further tightened.

3, The engagement of the handcuff is independent of the engagement of the stop ratchet. The engagement of the handcuff prevents the handcuff from loosening or prevents the moving strand from rotating in clockwise direction; this engagement is independent of the force applied on the inner side of the stop ratchet. The engagement of the stop ratchet prevents the handcuff from further tightening or prevents the moving strand from rotating in counter clockwise direction, this engagement is independent of the forward movement or clockwise movement of the moving strand of the handcuff.

4, The handcuff of the invention can be easily engaged and locked like a conventional handcuff without manually pushing the lock latch. The handcuff can be easily disengaged and unlocked like a conventional handcuff with a special key and without manually reset the lock latch. The handcuff is over-tighten-prevented automatically regardless how fast the handcuffing is being procedure, or how hard the restrained one is fighting in being handcuffed. The handcuff of the invention is much quick and much safer in operation.

Refer to FIG. 1. FIG. 1 is an illustration of one of the embodiments of the handcuff invention. The double strand is 101, which is the main body of the handcuff; the moving strand is 102, which is the moving half of the handcuff, the moving strand 102 has three main parts: a left ratchet, a right ratchet and a stop ratchet; the first rivet is 10, which is the rotation axis of the moving strand 102; the second rivet is 20, which is the rotation axis of the stop ratchet 104; wherein the moving strand 102 rotates around the first rivet 10 freely when the handcuff is not engaged/locked, the moving strand 102 can be engaged or disengaged with their paired stop pawls. FIG. 1 shows the moving strand 102 is disengaged, and the handcuff is disengaged and not locked; wherein 104 is the stop ratchet, which stops the rotation of the moving strand 102 when 104 is engaged with a middle stop pawl, and prevents the handcuff from further tightening. The term disengaged means not engaged. It can be seen that when the handcuff is in open condition, there is no big difference with a conventional handcuff.

Figure 2:
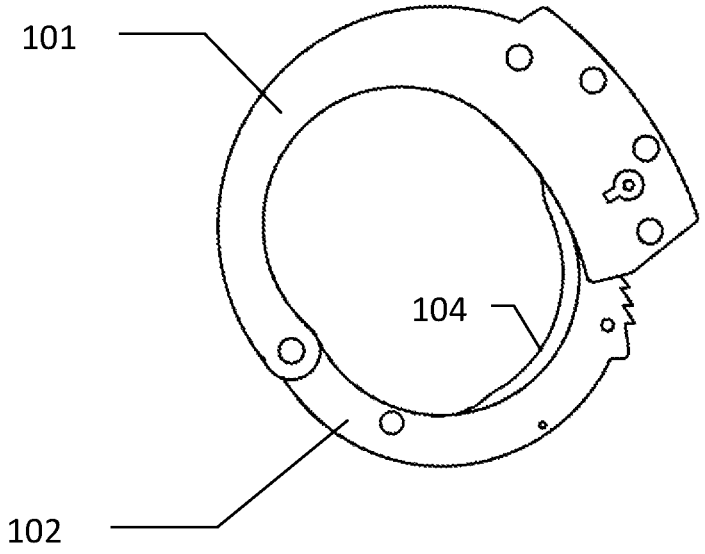
FIG. 2 is an illustration of one of the embodiments of the invention when the handcuff is engaged but not locked.

Refer to FIG. 2, the double strand is 101, the moving strand is 102; wherein the moving strand 102 is engaged, and the handcuff is engaged and cannot be loosened without a key; wherein 104 is the stop ratchet, wherein 104 is in its free position and not engaged with the middle stop pawl, the handcuff is not locked and can be further tightened. It can be seen that when the handcuff is in closed condition but no force is applied on the stop ratchet 104, there is no big difference with a conventional handcuff. But when 104 is pressed from inner side and is moved outwards of the moving strand 102, at certain position it will be engaged with the middle stop pawl, then the handcuff is locked and cannot be further tightened.

Figure 3:
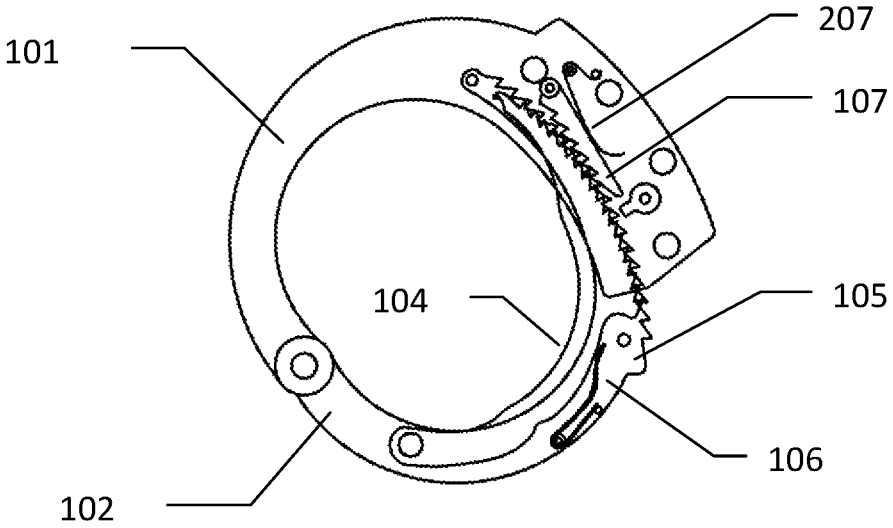
FIG. 3 is a partial transparent illustration of one of the embodiments of the invention when the moving strand is engaged but the stop ratchet is not engaged.

FIG. 3 is a partially transparent view of the handcuff showing the internal relations of FIG. 2. The moving strand 102 is engaged, but the stop ratchet 104 is disengaged or not locked. Wherein the tension spring is 106, right ratchet is 105, the right stop pawl is 107, when the stop ratchet 104 is not being pressed outwards, the tension spring 106 is released (in free position), and the stop ratchet is not engaged with its paired stop pawl, while the right ratchet 105 keeps engaged with the right stop pawl 107. In this situation, the moving strand 102 is engaged but can be rotated counter-clockwise and the handcuff can be further tightened (or can be made smaller in inner perimeter), and the moving strand cannot be rotated clockwise without releasing (disengaging) the right stop pawl 107. The handcuff is engaged and cannot be loosened without a key but it is not locked and can be further tightened because the stop ratchet 104 is not engaged.

Figure 4:
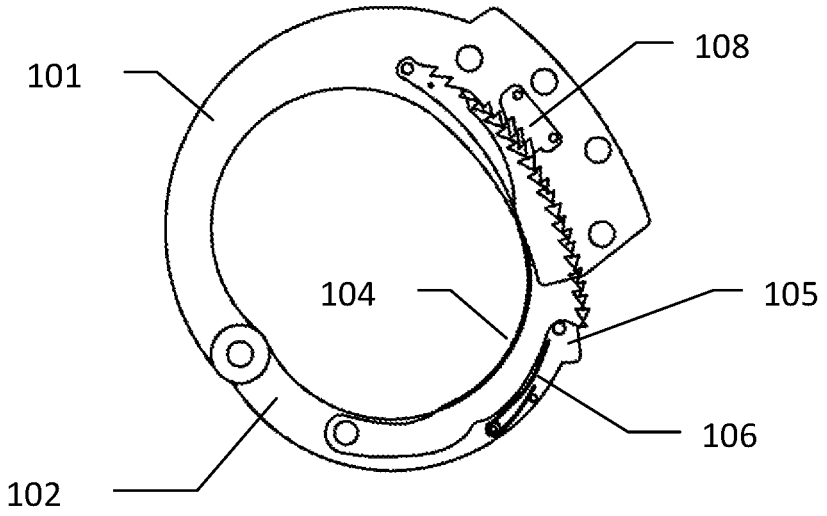
FIG. 4 is a partial transparent illustration of one of the embodiments of the invention when both the moving strand and the stop ratchet are engaged.

FIG. 4 is a partially transparent view of the handcuff wherein both the right ratchet 105 of the moving strand 102 is engaged and the stop ratchet 104 is engaged or locked. Wherein the stop ratchet 104 is pressed to move outwards, the tension spring 106 is pressed. In this situation, the stop ratchet 104 is engaged with the middle stop pawl 108 at certain position when it is pressed and moved towards its outmost position, then the moving strand 102 cannot be rotated in any direction and the handcuff cannot be further tightened (or cannot be made smaller in inner perimeter) and cannot be removed without a key. It can be noticed that the moving strand 102 cannot be released without releasing (disengaging) the middle stop pawl 108 and/or the right stop pawl 107 (107 is shown in FIG. 3) when the handcuff is being engaged and locked. When the stop ratchet 104 is engaged with the middle stop pawl 108, physic injures by any further tightening of the handcuff can be securely prevented. In this situation, the handcuff is fully locked and cannot be removed because the moving strand 102 cannot be moved or rotated in both clockwise and counter clockwise directions. This example shows that the proposed handcuff is much better than a conventional one because it is automatically locked when force applied on handcuffed wrist or ankle is greater than a preset value; while in conventional handcuff further tightening still possible and physical injures will be worsened even when the handcuff is in very tight condition before manually pushing the lock latch.

Figure 5:
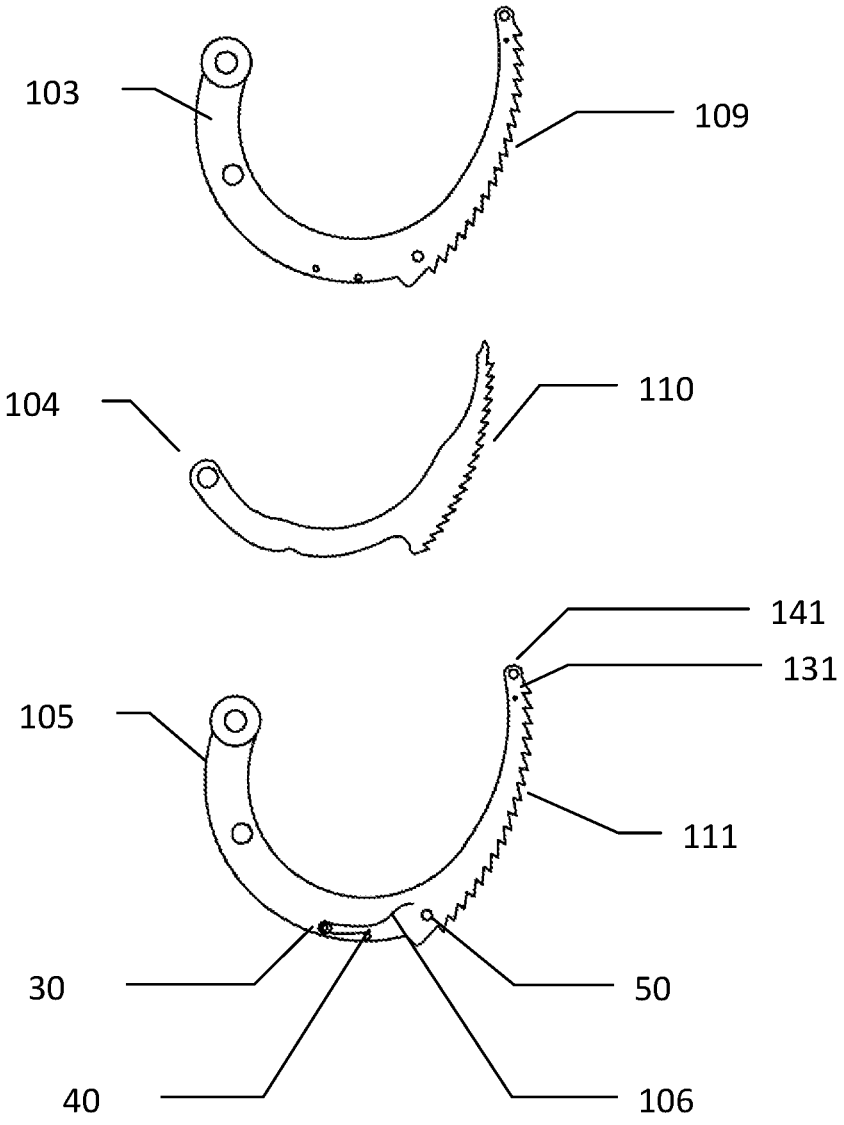
FIG. 5 is an illustration of the three parts and attached elements of the moving strand in one of the embodiments of the invention.

FIG. 5 is an illustration of the three main parts and attached elements of the moving strand 102 in one of the embodiments of the invention. Left ratchet is 103, teeth of the left ratchet are 109. The stop ratchet is 104, teeth of the stop ratchet are 110. Right ratchet is 105, teeth of the right ratchet is 111. Connection pin 141 is used to hold the left ratchet 103 and right ratchet 105 together while allows stop ratchet 104 rotating in between left ratchet 103 and right ratchet 105 before 104 is engaged or before its position limits are reached. Left limiter 131 is used to limit the left outmost position of the stop ratchet 104, left limiter 131 is mounted on right ratchet 105, the stop ratchet 104 stops when it touches left limiter 131. Right limiter 50 is used to limit the right outmost position of the stop ratchet 104, the stop ratchet 104 stops when it touches the right limiter 50. Tension spring 106 is used to preset the force on stop ratchet 104, one end of the tension spring 106 is always in touching against the lower side of the stop ratchet 104 when assembled; when the force applied on inner side of stop ratchet 104 is greater than the preset tension force of 106, the stop ratchet 104 rotates clockwise before it touches the middle stop pawl or right limiter 50; when the force applied on inner side of stop ratchet 104 is smaller than the preset tension force of 106, stop ratchet 104 rotates counter-clockwise before it touches the left limiter 131. Pin 30 is used to fix and position the tension spring 106, pin 40 is used to fix the other end of the tension spring 106. The left ratchet 103 and right ratchet 105 are aligned in position in this example when assembled so that 103 are not shown in FIG. 3 and FIG. 4; actually the left ratchet 103 is aligned with right ratchet 105 and they are overlapped and coincided in FIG. 3 and FIG. 4.

It is to be noticed that the direction of the teeth of the stop ratchet is opposed to the direction of the teeth of left ratchet; the direction of the teeth of the stop ratchet is opposed to the direction of the teeth of right ratchet.

Figure 6A:
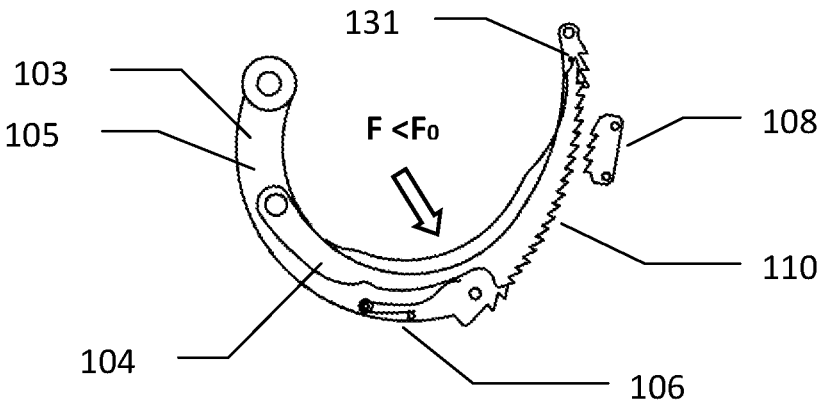
FIG. 6A is an illustration of the relations of the moving strand and the middle stop pawl in one of the embodiments of the invention, wherein the stop ratchet is not engaged or not locked.

A further detailed explanation of the moving strand 102 is shown in FIG. 6A, wherein left ratchet 103 is transparent in illustration and fully coincided with right ratchet 105 in the view, stop ratchet 104 is partially transparent in illustration to show their relations. Wherein the stop ratchet 104 is pressed by an external force F while F is zero or smaller than F0, tension spring 106 is in released condition, the illustrations show that the teeth 110 of the stop ratchet 104 are separated (1 mm-4 mm apart) with the teeth of the middle stop pawl 108. In real situation, left ratchet 103, stop ratchet 104, right ratchet 105 are made of metal or enforced plastics and are not generally transparent as shown in FIG. 6A. Supposing the equivalent preset tension force of the spring is F0, when the force F applied on the inner side of the stop ratchet 104 is less than F0, the stop ratchet 104 is rotating counter-clockwise and stops by the left limiter 131, the stop ratchet 104 is not touched with the middle stop pawl 108. At this position, the moving strand 102 as a whole is not locked and further tightening (counter clockwise) of the handcuff is still available.

Figure 6B:
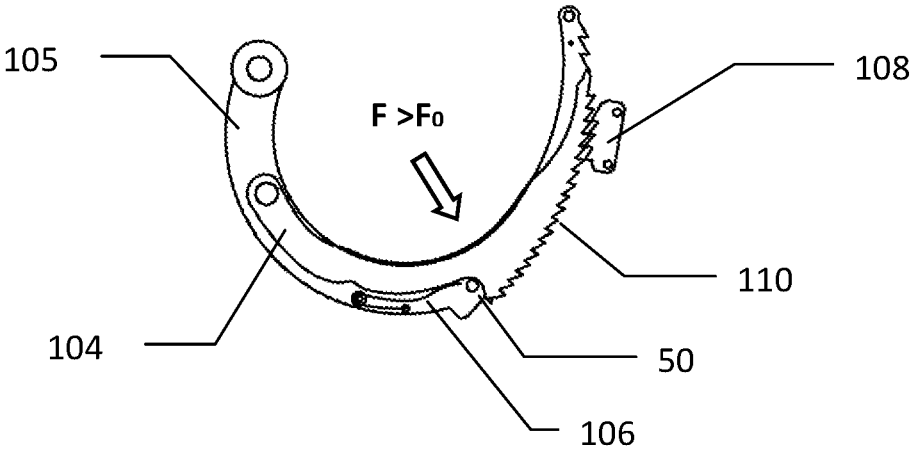
FIG. 6B is an illustration of the relations of the moving strand and the middle stop pawl in one of the embodiments of the invention, wherein the stop ratchet is engaged or locked.

Another detailed explanation of the moving strand 102 is shown in FIG. 6B, wherein left ratchet 103 is transparent in illustration and fully coincided with right ratchet 105 in the view, stop ratchet 104 is partially transparent in illustration to show their relations. Wherein the stop ratchet 104 is pressed by any external force F while F is great than the equivalent tension force F0 of the spring 106, tension spring 106 is in pressed condition, the illustrations show that the teeth 110 of the stop ratchet 104 is engaged with the teeth of the middle stop pawl 108. In real situation, left ratchet 103, stop ratchet 104, right ratchet 105 are made of metal or enforced plastics and are not generally transparent as in FIG. 6B. Supposing the equivalent preset tension force of the spring is F0, when the force F applied on the inner side of the stop ratchet 104 is greater than F0, the stop ratchet 104 is rotating clockwise and is stopped by the middle stop pawl 108. At this position, the moving strand 102 is locked and further tightening of the handcuff is not available, then the handcuff is locked. An extra clockwise limitation of the stop ratchet 104 is fulfilled by the right limiter 50.

Figure 7A:
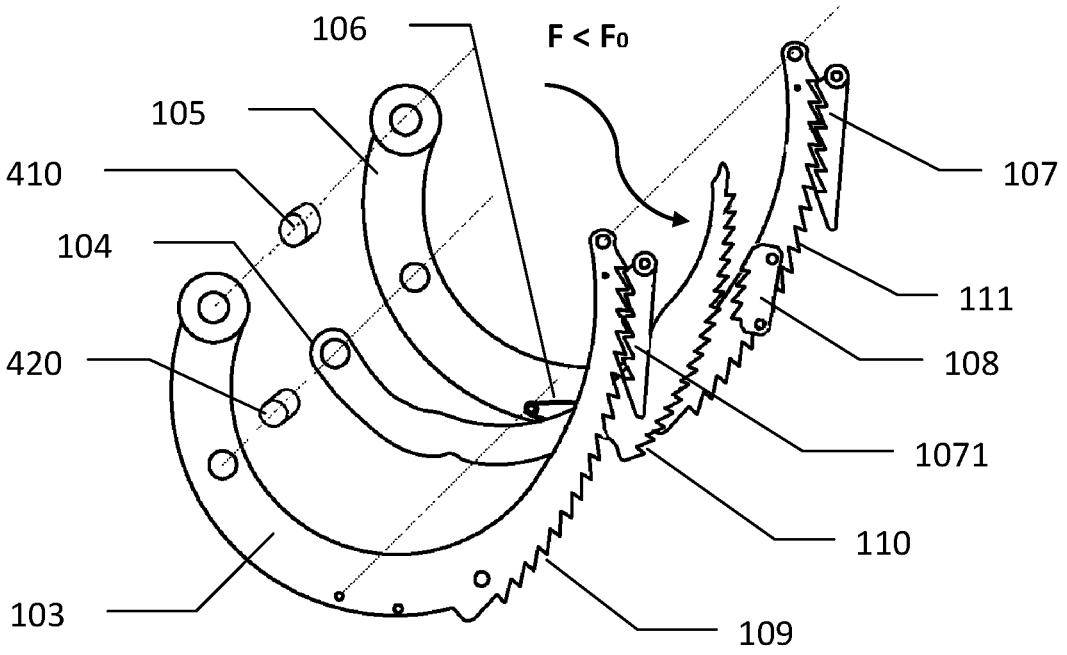
FIG. 7A is an illustration of the relative relations of the three parts of the moving strand and the three stop pawls in one of the embodiments of the invention, wherein the moving strand is engaged but not locked.

An exploded illustration of the moving strand 102 is shown in FIG. 7A, wherein left ratchet is 103, it has teeth 109, the left stop pawl 1071 is paired with 103; right ratchet is 105, it has teeth 111, and the right stop pawl 107 is paired with 105; stop ratchet is 104, it has teeth 110, the middle stop pawl 108 is paired with 104. Wherein stop ratchet 104 is not pressed or pressed by an external force F<F0, tension spring 106 is in released condition, the illustrations show that the teeth 110 of the stop ratchet 104 are separated (1 mm-4 mm apart) with the teeth of the middle stop pawl 108. The teeth

109 of left ratchet 103 are engaged with left stop pawl 1071. The teeth 111 of right ratchet 105 are engaged with right stop pawl 107. In this situation, the handcuff moving strand 102 can rotate counter-clockwise and further tightening is still available. Wherein the first axis pin is 410, which is a part of rivet 10, it is the rotation axis of the moving strand 102, wherein 102 comprises left ratchet 103, stop ratchet 104 and right ratchet 105. Wherein the second axis pin is 420, which is a part of rivet 20, it is the rotation axis of the stop ratchet 104. Wherein the left stop pawls 1071; the right stop pawl 107 and the middle stop pawl 108 are all mounted on the stiff body of double strand 101.

Figure 7B:
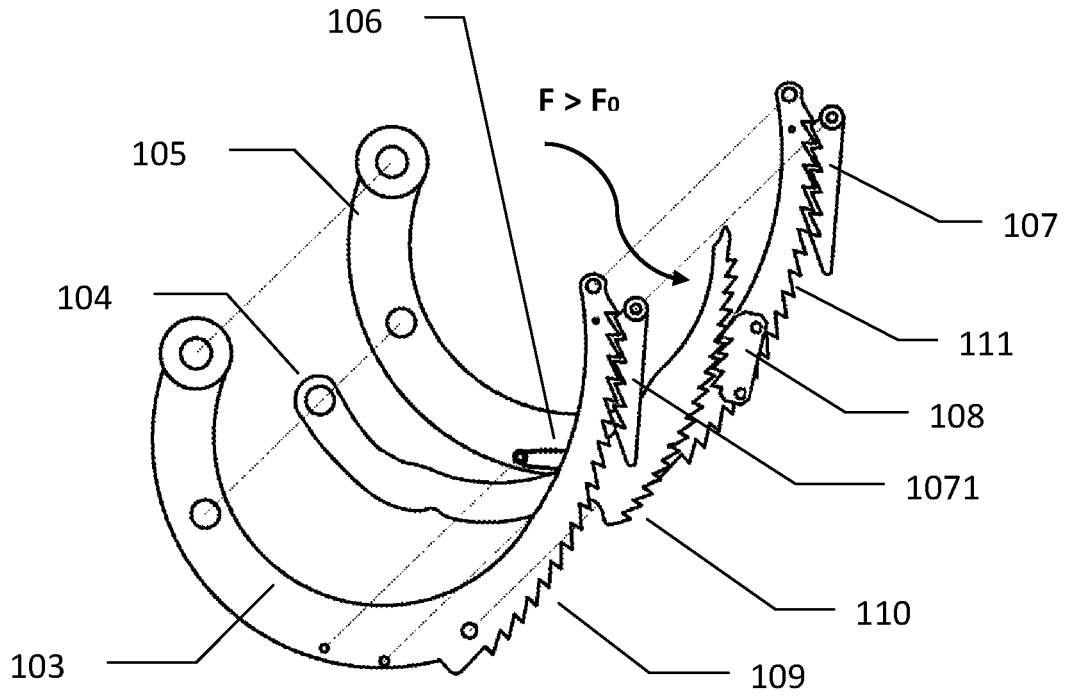
FIG. 7B is an illustration of the relative relations of the three parts of the moving strand and the three stop pawls in one of the embodiments of the invention, wherein the moving strand is both engaged and locked.

Another exploded illustration of the moving strand 102 is shown in FIG. 7B, all the components are as the same as in FIG. 7A except the position of the stop ratchet 104 and magnitude of the applied forced F, wherein left ratchet is 103, it has teeth 109; right ratchet is 105, it has teeth 111; stop ratchet is 104, it has teeth 110. Wherein stop ratchet 104 is pressed by an external force F>F0, tension spring 106 is in pressed condition, the illustrations show that the teeth 110 of the stop ratchet 104 are engaged with the teeth of the middle stop pawl 108. The teeth 109 of left ratchet 103 are engaged with left stop pawl 1071. The teeth 111 of right ratchet 105 are engaged with right stop pawl 107. In this situation, the handcuff moving strand 102 cannot rotate counter-clockwise and further tightening is not available, and the handcuff is in both engaged and locked condition. Any further operation of the handcuff is prevented unless a key is used to release the right stop pawl 107 and left stop pawl 1071 simultaneously. The left stop pawl 1071, the right stop pawl 107 and the middle stop pawl 108 are all mounted on the stiff body of double strand 101. Axis pins 410 and 420 keep the same as in FIG. 7A but are not shown in FIG. 7B.

Both left stop pawls 1071 and right stop pawl 107 are constrained by pawl tension springs respectively, the said pawl tension springs push the left and/or right stop pawls to rotate clockwise and engage with the left and right ratchets 103 and/or 105 respectively. Right stop pawl 107 and its pawl tension spring 207 are shown in FIG. 3. Left stop pawl 1071 and its pawl tension spring is the same as that of 107 but placed in different position and paired with left ratchet 103 and are not shown in figures.

The remaining parts of the handcuff (keys, swivels, links and the double strand) are similar to conventional ones which have been used for hundreds years, and are not further detailed in the description.

The swivel-chain links of the handcuff can be hinge links or rigid links.

The teeth 111 and 109 can be arranged with an offset, or the pawl 107 and 1071 can be arranged with an offset in clockwise or counter clockwise direction to increase the degree of difficulty in picking or shimming.

The example in above description can be simplified by eliminating the teeth of left ratchet 103 and eliminating the left stop pawl paired with the left ratchet 103. In this case loosing-preventing engagement is fulfilled by the right ratchet with its paired stop pawl; the over-tightening function is fulfilled by the stop ratchet and its paired stop pawl.

The example in above description can be further simplified by eliminating both the left ratchet 103 and the left stop pawl paired with the left ratchet 103. In this case loosing-preventing engagement is fulfilled by the right ratchet with its paired stop pawl; the over-tightening function is fulfilled by the stop ratchet and its paired stop pawl.

The invention meets six advantage conditions at same time:

A, automatic over tightening prevention without manual push-to-lock latch,

B, same size can be maintained as conventional handcuff,

C, same shape can be maintained as conventional one,

D, same handcuffing steps or procedures as conventional one,

E, faster or less complicated in restraining and removal,

F, very hard to be picked or shimmed because the handcuff can be removed only when both the right stop pawl 107 and left stop pawl 1071 are released simultaneously.

And there are more preferred outcomes, 1, an automatic over-tightening prevention mechanism is added in the moving strand, the manufacturing of the handcuff is almost the same as conventional one, 2, eliminate manually operated the push-to-lock latch in conventional handcuff without compromising any function, 3, reduce the restraining/removal time by 50% in handcuffing, The proposed handcuff provides a reliable over-tighten-prevention solution while keeps maximizing the compatibility with conventional handcuff (keep unchanged in size, shape, weight, application SOP and training).

The key innovations:

a), the moving strand comprises three parts (instead of a single part in conventional handcuff): two forward ratchets in two sides (left and right) and one stop ratchet in between, the overall shape of the moving strand is the same as that of conventional handcuff.

b), the forward ratchets work in exact same way of conventional handcuff.

c), the stop ratchet is kept within the two forward ratchets and left limiter when no force is applied on; and the stop ratchet is moved outwards of the two forward ratchets when a force greater than 1.51 bs is applied on and then is stopped by a stop pawl.

d), When the handcuff is restrained on a wrist or ankle, a force (>1.51 bs or any preset values) will be applied on the stop ratchet, then stop ratchet is immediately locked, and then the moving strand as a whole is securely locked. Further tightening is prevented. In above description, more precisely, the forced applied and/or tension force of the spring is actually the equivalent forces.

Here we claim:

1. A handcuff with automatic over-tightening-prevention mechanism, the handcuff comprises a double strand and a moving strand; the moving strand further comprises:

a toothed left ratchet, which is paired with a left stop pawl, a toothed right ratchet, which is paired with a right stop pawl, a toothed stop ratchet, which is paired with a middle stop pawl, a first rivet, a second rivet, a tension spring, wherein the stop ratchet is positioned in between the left and right ratchets, wherein the moving strand rotates about and around the first rivet, wherein the stop ratchet rotates about and around the second rivet, wherein when the stop ratchet is pressed from an inner side thereof, it rotates and moves outward of the left and right ratchets, wherein when the stop ratchet is pressed towards its outmost position, it pivots towards and is engaged with the middle stop pawl, and then it is stopped by its engagement with the middle stop pawl; wherein further tightening of the handcuff is prevented when the stop ratchet is engaged with the middle stop pawl, wherein the rotation of the stop ratchet is constrained by the tension spring, when force applied on the inner side of the stop ratchet is greater than equivalent tension force of the tension spring, the stop ratchet rotates clockwise, or moves outwards of the left and right ratchets; when force applied on the inner side of the stop ratchet is less than the equivalent tension force of the tension spring, the stop ratchet rotates counter clockwise, or moves inwards of the left and night ratchets.

2. The handcuff of claim 1, wherein:

the direction of the teeth of stop ratchet is opposed to the direction of the teeth of left ratchet;

the direction of the teeth of stop ratchet is opposed to the direction of the teeth of right ratchet;

the teeth of the stop ratchet are used to stop or lock the moving strand in tightening direction;

the teeth of the left and right ratchet are used to stop the moving strand in loosening direction.

3. The handcuff of claim 1, wherein:

the left ratchet and the right ratchet rotate around the first rivet simultaneously, the second rivet is the rotation axis of the stop ratchet, the rotation of the stop ratchet is independent of the rotation the left ratchet and the right ratchet.

4. The handcuff of claim 1, wherein a left limiter on the moving strand limits the left-most position of the stop ratchet when the stop ratchet rotates in counter clockwise direction;

a right limiter on the moving strand limits the right-most position when the stop ratchet rotates in clockwise direction.

5. The handcuff of claim 1, wherein the left ratchet and the right ratchet are fixed or connected by a connection pin at the far-most tips of the left ratchet and the right ratchet so that the rotation of the left ratchet and the right ratchet are simultaneous.

6. The handcuff of claim 1, wherein tension of the tension spring can be preset by choosing different stiffness of the tension spring, so that the tension or equivalent tension force of the over-tightening-prevention mechanism can be preset at different values, the stiffer the tension spring, the bigger the force applied to activate the mechanism or to lock the handcuff; the softer the tension spring, the smaller the force applied to activate the mechanism or to lock the handcuff.

7. A handcuff with automatic over-tightening-prevention mechanism, the handcuff comprises a double strand and a moving strand; the moving strand further comprises:

a left ratchet, a toothed right ratchet, which is paired with a toothed right stop pawl, a stop ratchet, which is paired with a middle stop pawl, a first rivet, a tension spring, wherein the stop ratchet is positioned in between the left and right ratchets, wherein when the stop ratchet is pressed from an inner side thereof, it rotates and moves outwards of the left and right ratchets, wherein when the stop ratchet is pressed towards its outmost position, it is engaged with the middle stop pawl and is stopped by its engagement with the middle stop pawl; wherein further tightening of the handcuff is prevented when the stop ratchet is engaged with the middle stop pawl, wherein the moving strand rotates about and around the first rivet, wherein the stop ratchet rotates about and around the second rivet, wherein the rotation of the stop ratchet is constrained by the tension spring, when force applied on the inner side of the stop ratchet is greater than equivalent tension force of the tension spring, the stop ratchet rotates clockwise, or moves outwards of the left and right ratchets; when force applied on the inner side of the stop ratchet is less than the equivalent tension force of the tension spring, the stop ratchet rotates counter clockwise, or moves inwards of the left and night ratchets.

8. The handcuff of claim 7, wherein:

the stop ratchet is used to stop or lock the moving strand in tightening direction;

the teeth of the right ratchet is used to stop the moving strand in loosening direction.

9. The handcuff of claim 7, wherein:

the left ratchet and the right ratchet rotate around the first rivet simultaneously, the second rivet is the rotation axis of the stop ratchet, the rotation of the stop ratchet is independent of the rotation of the left ratchet and the right ratchet.

10. The handcuff of claim 7, wherein a left limiter on the moving strand limits the left-most position of the stop ratchet when the stop ratchet rotates in counter clockwise direction;

a right limiter on the moving strand limits the right-most position of the stop ratchet when the stop ratchet rotates in clockwise direction.

11. The handcuff of claim 7, wherein the left ratchet and the right ratchet are fixed or connected by a connection pin at the far-most tips of the left ratchet and the right ratchet so that the rotation of the left ratchet and the right ratchet are simultaneous.

12. The handcuff of claim 7, wherein tension of the tension spring can be preset by choosing different stiffness of the tension spring, so that the tension or equivalent tension force of the over-tightening-prevention mechanism can be preset at different values, the stiffer the tension spring, the bigger the force applied to activate the mechanism or to lock the handcuff; the softer the tension spring, the smaller the force applied to activate the mechanism or to lock the handcuff.

13. A handcuff with automatic over-tightening-prevention mechanism, the handcuff comprises a double strand and a moving strand; the moving strand further comprises:

a right ratchet, which is paired with a night stop pawl, a stop ratchet, which is paired with a middle stop pawl, a first rivet, a second rivet, a tension spring, wherein the stop ratchet is positioned side by side with the right ratchet, wherein when the stop ratchet is pressed from an inner side thereof, it rotates and moves outward of right ratchet, wherein when the stop ratchet is pressed towards its outmost position, it is engaged with the middle stop pawl and is stopped by its engagement with the middle stop pawl; wherein further tightening of the handcuff is prevented when the stop ratchet is engaged with the middle stop pawl, wherein the moving strand rotates about and around the first rivet, wherein the stop ratchet rotates about and around the second rivet, wherein the rotation of the stop ratchet is constrained by the tension spring, when force applied on the inner side of the stop ratchet is greater than equivalent tension force of the tension spring, the stop ratchet rotates clockwise, or moves outwards of the right ratchet; when force applied on the inner side of the stop ratchet is less than the equivalent tension force of the tension spring, the stop ratchet rotates counter clockwise, or moves inwards of the right ratchet.

14. The handcuff of claim 13, wherein:

the stop ratchet is used to stop or lock the moving strand in tightening direction; when the stop ratchet is engaged with the middle stop pawl, further moving of the moving strand in tightening direction is prevented, the right ratchet is used to stop the moving strand in loosening direction, when the right ratchet is engaged with the right stop pawl, backwards moving of the moving strand is prevented.

15. The handcuff of claim 13, wherein:

the right ratchet rotates around the first rivet, the second rivet is the rotation axis of the stop ratchet, the rotation of the stop ratchet is independent of the rotation the right ratchet.

16. The handcuff of claim 13, wherein a left limiter on the right ratchet limits the left-most position of the stop ratchet when the stop ratchet rotates in counter clockwise direction;

a right limiter on the right ratchet limits the right-most position of the stop ratchet when the stop ratchet rotates in clockwise direction.

17. The handcuff of claim 13, wherein tension of the tension spring can be preset by choosing different stiffness of the tension spring, so that the tension or equivalent tension force of the over-tightening-prevention mechanism can be preset at different values, the stiffer the tension spring, the bigger the force applied to activate the mechanism or to lock the handcuff; the softer the tension spring, the smaller the force applied to activate the mechanism or to lock the handcuff.

18. The handcuff of claim 13, wherein configuration of the stop ratchet is to rotate around the second rivet freely when a force applied on inner side of the handcuff is over-balanced with the preset spring tension force, the said force applied is independent of the operation of the handcuff; the handcuff is locked immediately whenever the force applied on the inner side of the stop ratchet is greater than the preset spring tension force regardless whatever the handcuff is restraining on, and regardless how hard the moving strand is being pushed from outside of the handcuff.

* * * * *